US005819577A

United States Patent [19]

D'Arcy

[11] Patent Number: 5,819,577

[45] Date of Patent: Oct. 13, 1998

[54] ACCESSORY KIT FOR A BENDING BRAKE FOR BENDING CURVES IN SHEET METAL

[76] Inventor: Kevin Paul D'Arcy, 764 Limekiln Rd., Doylestown, Pa. 18901

[21] Appl. No.: 880,728

[22] Filed: Jun. 23, 1997

[51] Int. Cl.[6] ..... B21D 5/04

[52] U.S. Cl. ..... 72/321

[58] Field of Search ..... 72/319–321, 322, 72/293

[56] References Cited

U.S. PATENT DOCUMENTS

| | | | |
|---|---|---|---|
| 338,079 | 3/1886 | Kittredge | 72/321 |
| 338,100 | 3/1886 | Ohl | 72/319 |
| 2,208,061 | 7/1940 | Warger | 72/321 |
| 2,325,736 | 8/1943 | Bowman | 72/319 |

FOREIGN PATENT DOCUMENTS

| | | | |
|---|---|---|---|
| 14364 | 5/1934 | Australia | 72/321 |
| 120909 | 11/1877 | France | 72/321 |

OTHER PUBLICATIONS

Pp. 59–63 of Sheet Metal Workers' Manual, by Broemel et al, published 1939 by Frederick J. Drake.

Brochure for Van Mark bending brakes.

Brochure for Tapco portable bending brakes.

Portions of a brochure for Roper Whitney bending brakes.

*Primary Examiner*—Daniel C. Crane

*Attorney, Agent, or Firm*—William H. Meise

[57] ABSTRACT

An accessory kit for a portable bending brake allows bends and rebends to be made in elongated sheet-metal workpieces. The bending brake with which the kit is used has an elongated bed, a clamp which bears against the bed, and a bending apron hinged to the bed around a hinge axis. The kit includes at least one mandrel holder which bears a curved mandrel such as a pipe, and which holds the curved mandrel with its forward surface before the hinge of the apron. The kit also includes an apron fill piece and an auxiliary apron, which has a curved surface normally located below the support plane of the bed.

2 Claims, 12 Drawing Sheets

ACCESSORY KIT FOR A BENDING BRAKE FOR BENDING CURVES IN SHEET METAL

FIELD OF THE INVENTION

This invention relates to the bending of sheet-metal, and more particularly to attachments or accessories which allow the bending of curves in elongated pieces of sheet metal using conventional sheet-metal brakes.

BACKGROUND OF THE INVENTION

With increasing emphasis being placed on environmental considerations, lead and other materials are no longer used in exterior oil paints. As a result, oil-painted exterior coatings now last only a relatively short time. This, in turn, means that exterior wood surfaces which require paint must be repainted frequently, possibly every year in inauspicious locations. While repainting of wood siding, facias, soffets, and exterior wood portions of windows has always been necessary, lead-bearing paints lasted many times longer than non-lead paints, at least in some applications.

As a result of the frequent need for repainting of traditional exterior wood surfaces when using modern paints, modern houses and buildings are now often made with polymer or polymer-coated exterior surfaces, or with aluminum exerior surfaces. Windows and siding are at the vanguard of the transition to non-wood exterior surfaces, while other surfaces, such as facias and soffets, are still made chiefly from wood. The nation has a large stock of older dwellings and buildings, made with at least some traditional wooden exterior sufaces. These traditional surfaces must be repainted, as their old-style paint wears off, as otherwise deterioration sets in, eventually requiring replacement of the structural member underlying the painted surface.

The replacement of soffets, facias or siding is expensive, especially considering that the prices of wood have been rising, while the wooden parts of windows generally cannot be replaced individually, so that the entire window must be replaced when deterioration of the wood occurs. Inexpensive and durable materials which might exactly replace deteriorated wood fascia and soffets are not available. Many of our older houses were made in styles which included fancy wood moldings on exterior surfaces, such as, for example, crown moldings placed at the juncture between soffet and facia, or between facia and roofline. The owners of homes having such features may believe that the features give their homes a desirable appearance, and may wish to retain the features in order to maintain the perceived value of the home, or for their own satisfaction.

A homeowner who wishes to protect exterior wood features of an older home, and who is not inclined to repaint with the frequency required by modern paints, may choose to have the exterior wooden surfaces of the dwelling covered with sheet aluminum. Sheet aluminum covering is advantageous in that the aluminum is essentially weatherproof, and takes paint well. The aluminum covering protects the underlying wooden structure from external environmental effects (although in some climates vapor barrier must also be placed on adjacent interior surfaces to protect against condensation of moisture on the interior of the aluminum coating). Aluminum is made in long rolls expressly for the covering of exterior wood surfaces, and is precoated, in various colors, with high-quality enamel which stands up well to weather. The artisans who install such aluminum surfaces to exterior wood surfaces must cut the aluminum sheet to dimensions appropriate to the exterior wood surface to be covered, conform the aluminum to the shape of the wooden surface, and attach the resulting bent piece of aluminum to the wooden surface. Soffets and facias on an old house may be longer than the dimensions of the underlying house. For example, a house which has a 45° shed-style roof, and which has a horizontal length of twenty feet, will have a soffet and facia length of about twenty-eight feet. It is desirable, when installing sheet-metal coverings over such long surfaces, to reduce to a minimum the number of joints in the aluminum covering, to thereby allow the least number of paths for the ingress of moisture, and also to reduce to a minimum the number of joints which must be calked.

The flat sheet aluminum workpiece from the coil should be conformed to the shape of the underlying wooden surface to which it is to be applied, in order to maintain the exterior appearance of the covered surface, and also in order to provide support for the relatively thin aluminum against inadvertent strikes, as by birds, balls and the like, to prevent denting. When the cross-section of the wooden surface to be covered lacks curves (is rectilinear), the tool ordinarily used for shaping the aluminum sheet is a bending brake. In order to reduce the number of joints required in covering a long wooden structure, the bending brake should be as long as possible, and are often ten feet long, and possibly as long as fourteen feet. Conventional bending brakes, such as those used in machine shops, and for manufacturing (industrial applications), are made to handle both thick and thin sheet metal. Such conventional bending brakes are manufactured by many companies, including Roper Whitney Co., 2833 Huffman Boulevard, Rockford, Ill. 61101. As a consequence of the variety of sheet-metal thicknesses which they may have to handle, the conventional bending brakes have thickness adjustments, and because of the heavy gauge metal which they may be required to bend, are made in a very sturdy manner, and the combination of the adjustable and sturdy construction results in bending brakes which are very heavy, and which are not suited for portable use. For example, the model 1016 brake made by Roper Whitney has a length of about ten feet, and weighs 2660 pounds.

FIG. 1 is a simplified cross-section of a heavy-duty sheet-metal brake. In FIG. 1, the brake includes an underlying support structure including a bed 50 with a support platform 50*p*, and two vertical stiffener members 50*a* and 50*b*. The underside of the front edge 50*f* of the platform 50*p* is supported by an angle member 50*m* which extends from near the front edge down to stiffener 50*a*. The brake of FIG. 1 also includes a lower jaw or lower beam 54 which is supported by the support platform 50. The sheet-metal workpiece (not illustrated in FIG. 1) is supported by the upper surface of lower beam 54 when being bent. An upper jaw or clamping bar is illustrated as 58. Clamping bar 58 can be moved upward and downward relative to lower bar 54, to provide a gap between the clamping bar 58 and the lower bar 54 into which the sheet-metal workpiece may be inserted and clamped in position. In FIG. 1, the clamping bar 58 is illustrated as being clamped against the lower bar 54, so there is no actual gap, but the seam in the gap lies in a plane designated 80. Clamping bar 58 is supported by a movable structure 60, including a lower support 60*l*, an upper beam 60*b*, and two angle supports 60*c* and 60*d*. A keystone-shaped cutout 60*k* formed in the lower surface of lower support 60*l* is provided to anchor one end of box or support fingers, not illustrated in FIG. 1. As illustrated, clamping bar 58 has a cutout near its lower front which accommodates a replaceable front or folding edge piece 62, which may be in the form of conventional box fingers when rectangular bends for box-like structures are to be made. The brake of FIG. 1 also includes a hinge axis illustrated as 66 (hinge not illustrated), around which an apron or bending leaf 70 can be pivoted. Apron 70 includes a main portion 70*m* and support elements 70*s* at its rear. Main portion 70*m* of apron 70 has a cutout at its upper front surface, which accommodates an apron filler plate 70*f*. An angle-iron front workpiece support 72 is affixed to the apron and filler plate by a bolt 72*b*. The apron 70 normally hangs or depends from the hinge axis 66 in the illustrated position under the influence of gravity. When a sheet-metal workpiece is clamped between the upper jaw 58 and the lower jaw 54 in the position suggested by dash-line plane 80, the apron can be rotated in the direction of arrow 76, thereby bringing the upper edge 70*u* of the apron, and the upper surface of angle iron 72, to bear against that portion of the workpiece 80 extending forward of the front edge of folding blade 62, and bending upward that portion of the workpiece before (in front of) the front edge of folding blade 62. The angle through which apron 70 is rotated determines the angle of the resulting bend in the workpiece.

Specialized lightweight portable bending brakes are made specifically for transportation to a site at which wood surfaces are to be covered, for bending the relatively light sheet metal used for such coverings. Such brakes are manufactured by Van Mark Products Corp., 24145 Industrial Park Drive, Farmington Hills, Mich. 48335-2864, and by Tapco International Corporation, 45657 Port Street, Plymouth, Mich. 48170-6010. According to their brochure, the Van Mark model M1050, which is about ten feet long, weighs only 121 pounds. A disadvantage of industrial bending brakes, such as that of FIG. 1, is that, in the absence of accessories, only straight bends to some maximum angle can be made. For example, a conventional bending brake without accessories can make only straight bends at angles from about 0° to about 130°.

Rain gutters for houses are conventionally made from lightweight aluminum, and have curved cross-sections. These are ordinarily supplied ready-made in ten-foot lengths, for assembly at the installation site by the use of prefabricated connectors at each seam. When seamless aluminum gutters are made on-site from coil stock, they are fabricated by specialized roller-style bending machines. Gutters, however, are not used principally to cover an underlying surface, and the curved gutter shape which the roller machine makes does not need to be adjusted to conform to the shape of an underlying surface to be protected.

When a wooden surface to be covered with protective sheet-metal contains curves, as might be the case, for example, for a crown molding, a conventional bending brake without accessories cannot be used to bend sheet metal to conform, and a fixed-curve type of roller machine may not accept sheet metal having a preliminary bend.

Accessories are available for conventional industrial bending brakes, which allow curves to be bent. Such accessories are provided by Roper Whitney under the names "Tinner's Moulds" and "Radius Former Bars," with the radius former bars being supplied in sizes ranging from ⅛ inch radius to about 2½ inch radius, with size increments by 1/16 inch in the smaller sizes and ¼ inch increments in the larger sizes. The radius former bars are round bars or tubes which, in use, are bolted to holder fingers for ultimate support by the clamp of the bending brake. A 90° work support fixture affixed to the apron bends the sheet around the radius former bar, which may be viewed as being a mandrel. Thus, raising of the apron of the bending brake forms the sheet metal workpiece around the mandrel.

FIG. 2 is a perspective or isometric view of a portion of the brake of FIG. 1, fitted with a radius former bar. Elements of FIG. 2 corresponding to those of FIG. 1 are designated by like reference numerals. In FIG. 2, a support or holder finger 210 has its rear engaged in keystone-shaped notch 60*k* of lower support 60*l*. The front end of holder finger 210 is held against upper clamping bar 58 by a further bar 258 which has a slanted surface which bears against upper clamping bar 58, and by bolts 260 which screw into the holder finger. The distal or front end of holder finger 210 has through holes which allow a bolts 264 to be screwed into threaded holes (not visible) in a tab 266 of the radius former bar 268, to hold the radius former bar to the holder finger. In use, the upper jaw 60, with its attached former bar 268 is moved rearward, using the metal thickness control of the bending brake, until a vertical plane, represented by a dash block 272, tangent at dash line 274 to the curved front surface 270 of the radius former bar 268, is at the appropriate position relative to hinge axis 66. The upper jaw is then raised, a sheet of metal is introduced, and the upper jaw is then lowered to clamp the workpiece between the lower edge of the radius former bar 268 and the upper surface 54*u* of lower beam 54. The apron 70 (together with angle-iron workpiece support 72) is then pivoted up, in the direction of arrow 76, around hinge axis 66, to push the sheet-metal workpiece around the surface 270 of the radius former bar. For maximum angle of bend, the vertical plane 272 should be to the rear of a vertical plane passing through the hinge axis 66 by at least the thickness of the workpiece. Changeover to the radius former requires bolting the radius former support fingers to the clamp, then bolting the radius former bar to the distal ends of the support fingers. Since there may be many support fingers required to support a long former bar, such as a ten-foot former bar, the assembly of the radius former bar to an industrial bending brake is not something which can reasonably be expected to be performed many times during a workday.

FIGS. 3*a*, 3*b*, and 3*c* are simplified cross-sections of a bending brake arranged for making curved bends, as described at pages 57–71 of the text *Sheet Metal Workers' Manual*, by L. Broemel, published by Frederick J. Drake & Co., Chicago, 1939. In FIG. 3*a*, a bending brake includes a bed or lower jaw piece 50, an upper jaw piece 60, and an apron 70, pivoting around a hinge axis 66. A workpiece 310 is illustrated as being clamped between the upper and lower jaws. Workpiece 310 already has a flange 314 resulting from a right-angle bend 312 made during a previous bending step. A "fourth leaf" 320 is affixed to upper jaw 60, for reasons described below. A radius bar 368 is affixed to the uppermost edge of the apron. FIG. 3*b* illustrates the same structure as FIG. 3*a*, with the position of the workpiece 310 adjusted in the forward direction, and with the workpiece turned over so that the flange 314 produced by bend 312 faces downward. FIG. 3*c* illustrates the result of raising the apron with its curved former 368 past 90°, which allows the fourth leaf 320 to bear against the workpiece, and forms the sheet metal workpiece 310 over the radius of the former, and then returning the apron to the 90° position. As illustrated, the fourth leaf makes a bend 390 in the workpiece adjacent to the desired bend.

No such accessories for making curved surfaces are available for the portable bending brakes. Even if there were, the bending of a curve using the arrangement of FIGS. 3*a*, 3*b*, and 3*c* appears to require that there always be a bend, such as bend 390, adjacent to the desired curve. This requirement makes use of a fourth leaf generally useless for the purpose of matching the curves of molded wood.

FIG. 4*a* is a cross-section of the surface of a molding which might be encountered at a site. In FIG. 4*a*, the facia of a wall of a building is designated 10 and has an exterior surface 10*s*, and a soffet is designated 12. The roof sheathing is designated 14 and has a bottom surface 36, and the waterproof roofing material is 16. The junction between the facia 10 and the roof sheathing 10 is filled with a wooden molding designated generally as 20. Molding 20 includes a concave curve 22 grading into a convex curve 24, a pair of small right-angle bends 26*a* and 26*b*, a further concave bend 28, and a further pair of bends 30*a* and 30*b*. In addition, a vertical surface 32 lies between curve 22 and the roof sheathing 14. A wooden molding such as 14 will typically not have a right-angle bend at the confluence of the projections of flat support surfaces 10*s* and 36, but instead has a routed-out portion in order to allow the molding to sit flat against the underside of the roof sheathing 14 and the facia 10. In order to cover the exterior surface of molding 20 of FIG. 4*a*, an elongated aluminum piece 8 having a cross-sectional shape such as that illustrated in FIG. 4*b* must be fabricated. In FIG. 4*b*, the curved portions of sheet-metal sheathing piece 8 are designated by the same reference numerals as are the corresponding curves of the wood molding 20 of FIG. 4*a*. The aluminum sheath 8, in addition to the surfaces 22, 24, 26, 28, 30, and 32 recited in conjunction with the wood molding, and the surfaces 10*s* associated with the facia 10, has additional portions 40, 50, and 54. Portion 40 has a width selected to fit closely around the bottom of facia 10, and portion 50 is selected to provide sufficient nailing surface, while still allowing the sheet-metal sheathing piece 8 to be snapped into position over the molding and facia board. Portion 50 of the aluminum facia covering piece 8 will, in the final installation, itself be covered by a portion of an aluminum soffet sheathing piece (not illustrated). Also, portion 54 of the aluminum sheath 8 is provided to fit under the edge of the outermost of the waterproof roofing material 16. An artisan faced with the problem of covering a molding or surface containing one or more curves and bends, such as the surface of molding 20 of FIG. 4*a*, has, at the installation site, no ready means for making the desired bends, such as bend 26, in the presence of others of the desired curves, nor does he have any way to make the desired curves 22, 24, and 28. He may well have no access whatever to an industrial-type bending brake, much less to such a brake having the accessories necessary to making curves. Even if such a brake is available, the measurements must be made at the installation site, and carried to the location of the brake. The parts must then be bent at the location of the brake, and carried back to the installation site. Carrying bent pieces which may be ten or more feet long, without scratching or marring the finish, may itself be a problem. Regardless of the care taken in making the measurements, there will always be some error in the bends, requiring repeated back-and-forth trips. If the artisan has no access to such an industrial brake, he must make do with his portable brake, which is incapable of making the desired curves, and for which no accessories are available. This may result in loss of a job if the homeowner is adamant about maintaining the appearance of the surface, or, if the job is to be done anyway, some way must be found to approximate, in the sheet metal, the curved surface to be protected.

Improved brake accessories are desired.

SUMMARY OF THE INVENTION

An accessory kit allows the fabrication of elongated sheet-metal workpieces having curved surfaces on a sheet-metal bending brake. The sheet-metal bending brake for which the accessory kit is provided includes (a) an elongated bed defining a generally horizontal support surface for a sheet-metal workpiece, (b) an elongated clamp which is movable relative to the bed for clamping the sheet-metal workpiece against the bed, the clamp defining a front edge, and (c) an elongated apron hingedly connected along a first hinge axis near the front edge of the clamp for bending that portion of the sheet-metal workpiece extending forward of the front edge of the clamp relative to that portion lying to the rear of the front edge of the clamp. The apron, in most brakes, has a normal position in which gravity causes it to hang or depend from the brake hinge.

The accessory kit comprises an elongated mandrel holding piece which may be affixed to the clamp of the bending brake for use therewith. The mandrel holding piece includes a mandrel in the form of an elongated curved surface. The elongated curved surface has a cross-section along a principal portion of its length which is the same as the cross-section at other locations along the principal portion of its length, to thereby define an axis of elongation of the curved surface. The axis of elongation extends parallel to the direction of elongation of the mandrel holding piece near a front edge of the mandrel holding piece. The elongated mandrel holding piece, when affixed to the clamp, has the axis of elongation of the elongated curved surface lying parallel to the front edge of the clamp, and the curved surface lying forward of a vertical plane passing through the first hinge axis. Thus, the mandrel may be, in one embodiment, a portion of a circularly cylindrical tube, pipe or rod, with its axis parallel to the front edge of the clamp, with a vertical plane tangent to its curved forward surface lying forward of a vertical plane passing through the hinge axis or first axis of the bending brake.

The accessory kit includes an elongated apron fill piece which may be affixed to the apron of the bending brake. The apron fill piece includes an elongated hinge support which, when the apron fill piece is affixed to the apron of the bending brake and the mandrel holding piece is affixed to the clamp, has a second hinge axis lying near the vertical plane tangent to the curved surface of the mandrel. The accessory kit further includes an elongated auxiliary apron defining a front surface and a back surface. The auxiliary apron is hinged to the apron fill piece along the second hinge axis, with the front surface of the auxiliary apron facing away from the apron fill piece, so that the auxiliary apron in its non-bending or pendulous normal position lies generally below the support plane of the bed, and may be raised about the second hinge axis for bending the sheet-metal workpiece without raising the apron of the bending brake. The auxiliary apron defines a second curved surface on, or adjacent to, its front surface. The second curved surface has an axis of elongation lying parallel to the axis of elongation of the curved surface of the mandrel. The second curved surface is located below the hinge axis when the auxiliary apron is in its normal position, so as to provide clearance for sheet-metal workpieces which may already have a curve.

In one embodiment of the invention, the accessory kit contains a single mandrel holder, and other embodiments include a plurality of mandrel holders, but no apron fill pieces or auxiliary aprons.

DESCRIPTION OF THE INVENTION

Figure 5:
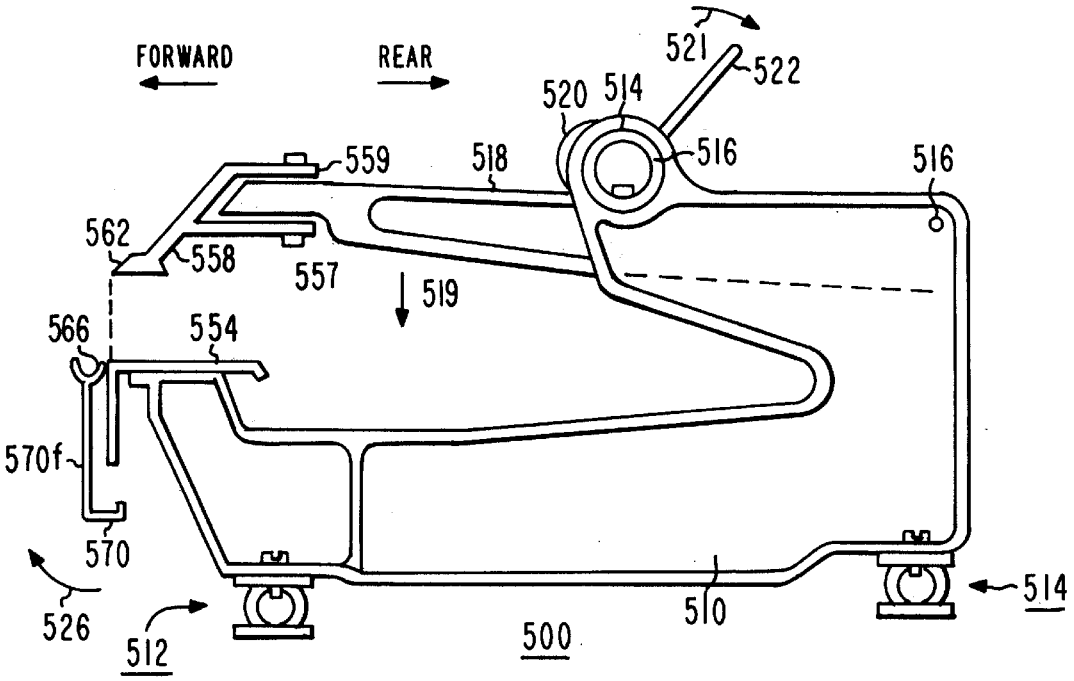
Fig. 5 PRIOR ART
FIG. 5 is a simplified side elevation of a portable bending brake, viewed from a location adjacent a single prior-art clamp, from among the many clamps of such a portable bending brake.

FIG. 5 is a side elevation of a single clamp 500 from among the clamps of a Van Mark portable bending brake. From about two to about a dozen or so of such clamps are spaced along the length of a portable bending brake, depending upon its length. The clamps are supported, in part, by a pair of beams designated 512 and 514, which are in the form of tubes with upper and lower flanges. In FIG. 5, the main casting or support is a clamp body 510, which defines a cam shaft aperture 514 and an upper jaw or clamp hinge aperture 516. An upper clamp 518 is hinged by an axle through aperture 516, so that it can move from the illustrated position in the direction of arrow 519. A cam, part of which is visible as 520, is affixed to an elongated cam drive shaft 516, which extends through the cam of each of the clamps 500 of the portable bending brake, and is keyed thereto, for rotating all of the cams simultaneously in response to pushing back (in the direction of arrow 521) of the clamp handle 522.

The clamp body 510 of clamp 500 of FIG. 5 bears an L-shaped lower beam 554, which provides a flat, horizontal surface for supporting the workpiece while it is being aligned in the brake, and also provides a support against which the upper jaw can clamp the workpiece while it is being bent. An apron 570, having a front surface 570*f*, is hinged at an axis 566 to the front of the lower beam 554, and normally hangs in the position illustrated. An upper clamping bar, in the form of an extrusion 558 having upper and lower arms 559 and 557, respectively, is bolted to the various clamps 500 of the bending brake. The lowermost portion 562 of clamping bar 558 bears against the upper surface of lower beam 554 when the clamp handle 522 is pushed back, thereby clamping between the two surfaces (the upper surface of beam 554 and the lower surface of lowermost portion 562 of the clamping bar 558) whatever workpiece is placed therebetween. Raising the apron 570 in the direction of arrow 576 by means of a handle (not illustrated) then bends the workpiece.

Figure 1:
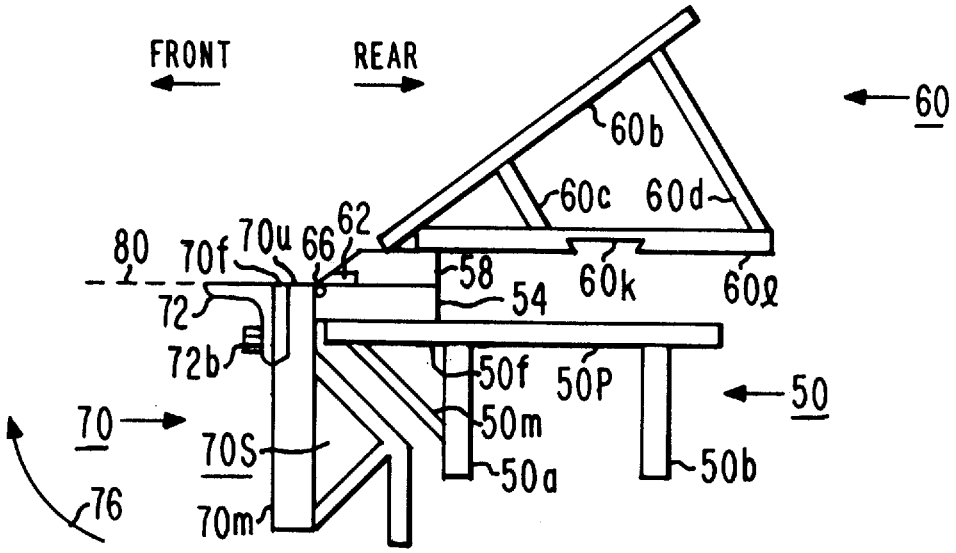
Fig. 1 PRIOR ART
FIG. 1 is a simplified cross-section of a prior-art heavy-duty or industrial-style sheet-metal brake.
Figure 2:
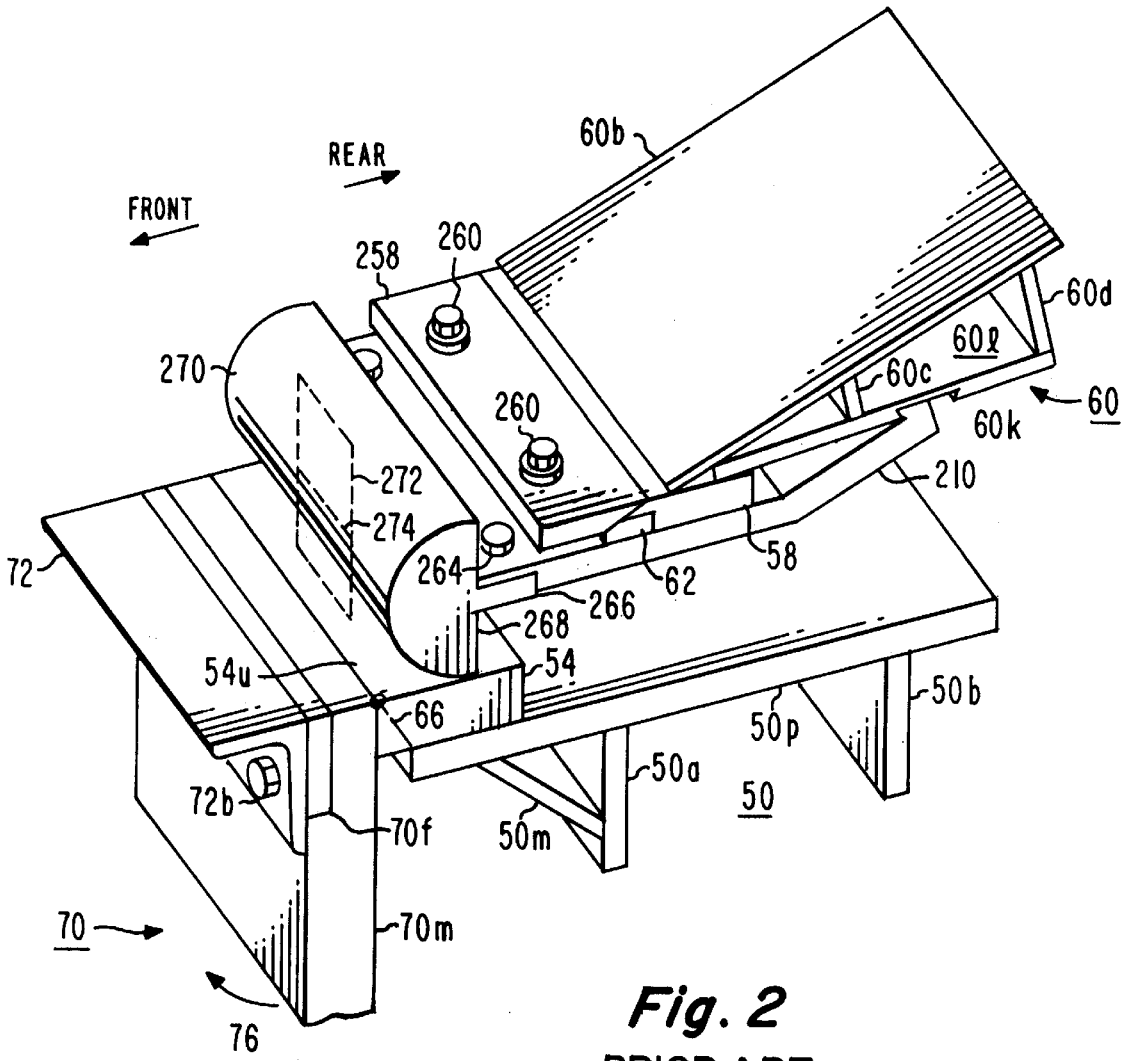
Fig. 2 PRIOR ART
FIG. 2 is a simplified perspective or isometric view of a portion of the brake of FIG. 1, fitted with a radius former bar.
Figure 3A:
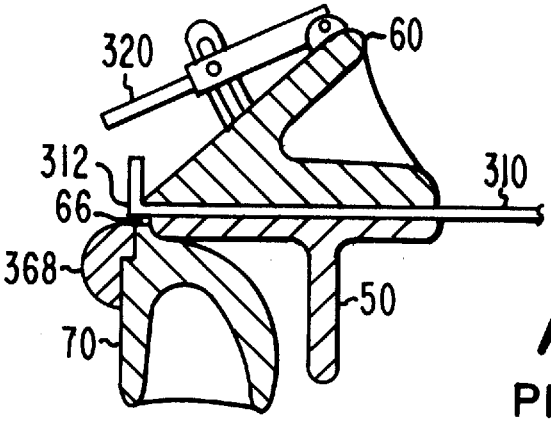
Fig. 3a PRIOR ART
FIGS. 3*a*, 3*b*, and 3*c* are simplified cross-sections of a prior-art bending brake arranged for making curved bends.
Figure 3B:
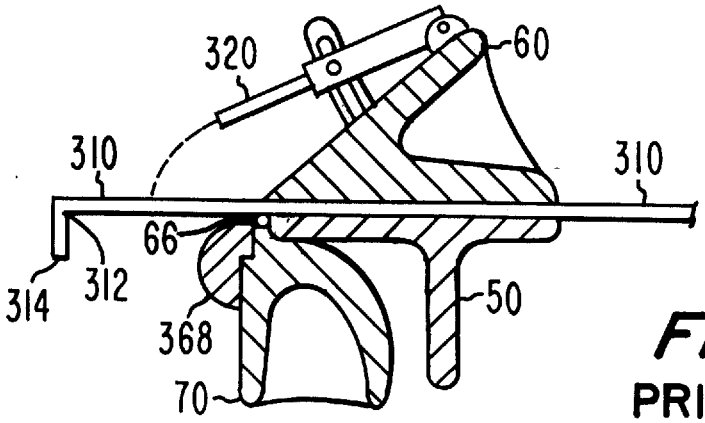
Fig. 3b PRIOR ART
Figure 3C:
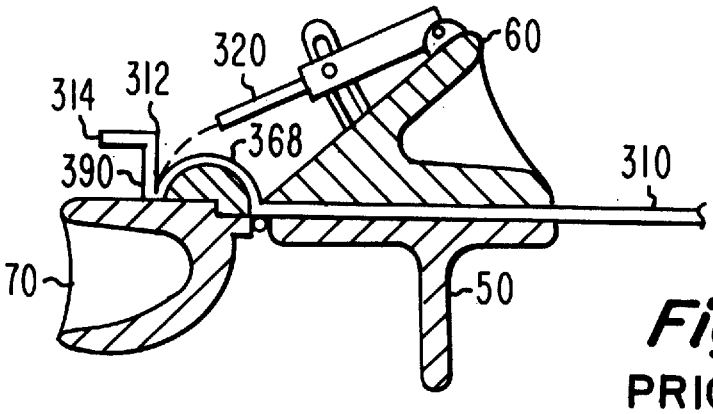
Fig. 3c PRIOR ART
Figure 4A:
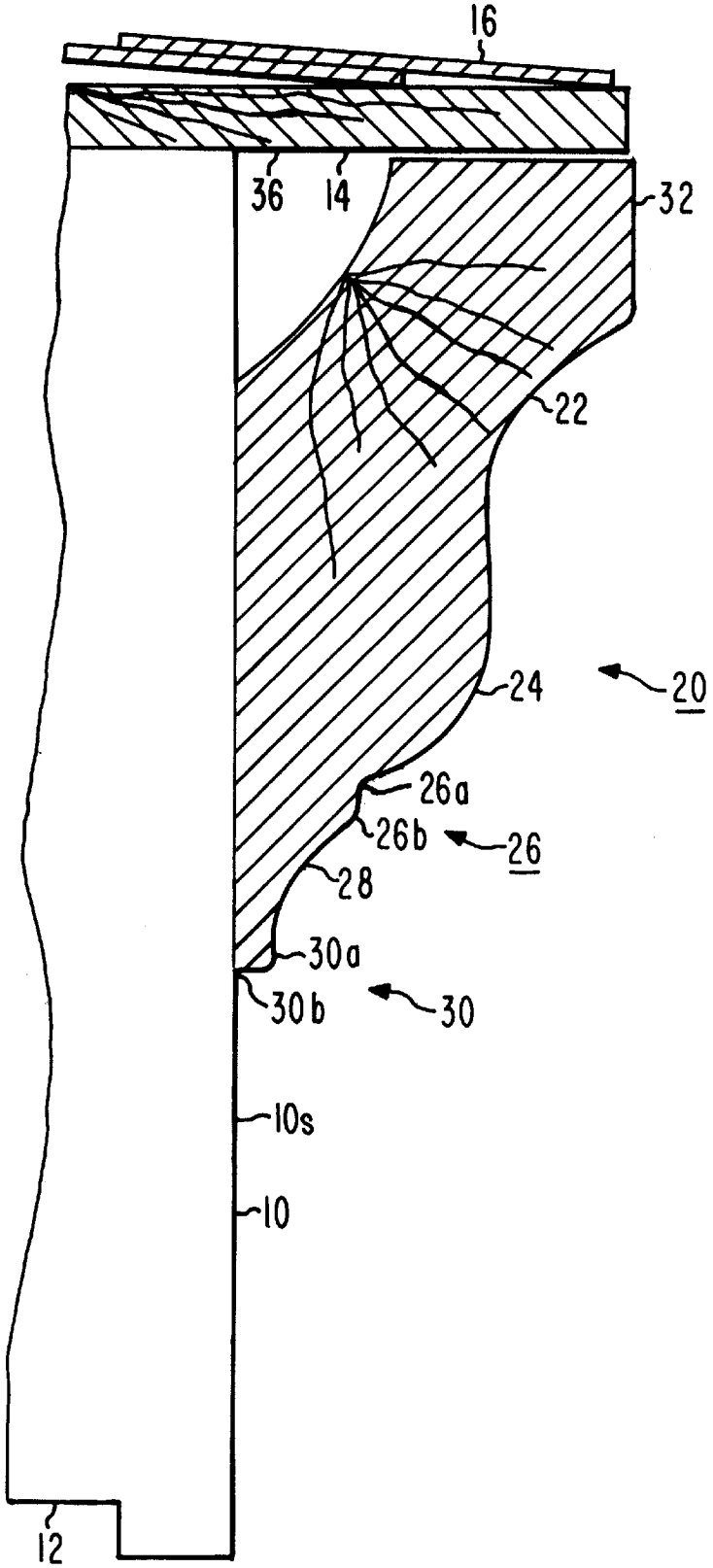
FIG. 4*a* is a cross-sectional view of a portion of a dwelling near a soffet, facia, fancy molding, and roof.
Figure 4B:
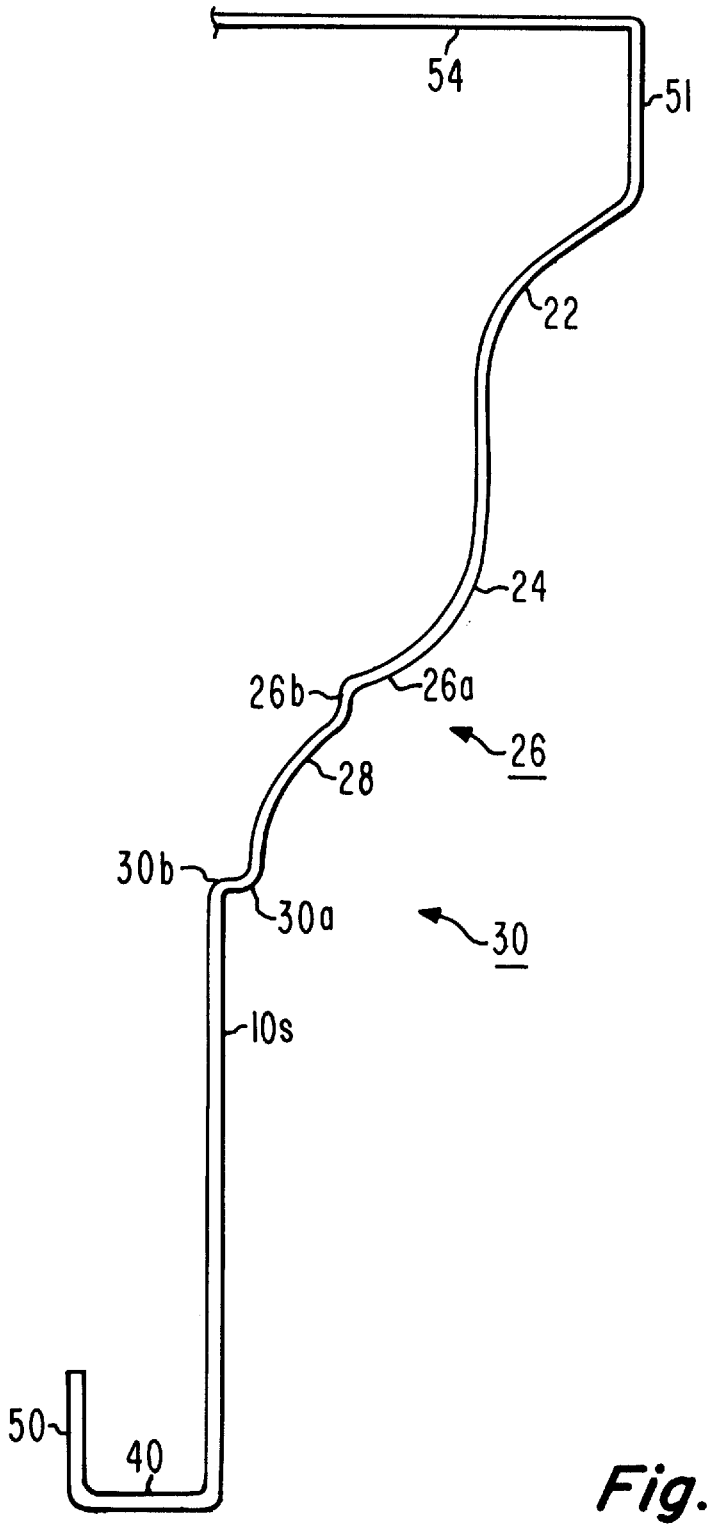
FIG. 4*b* illustrates the cross-section of a sheet-metal piece formed to fit as a sheath over the facia and fancy molding of FIG. 4*a*, and under the roofing material.
Figure 6:
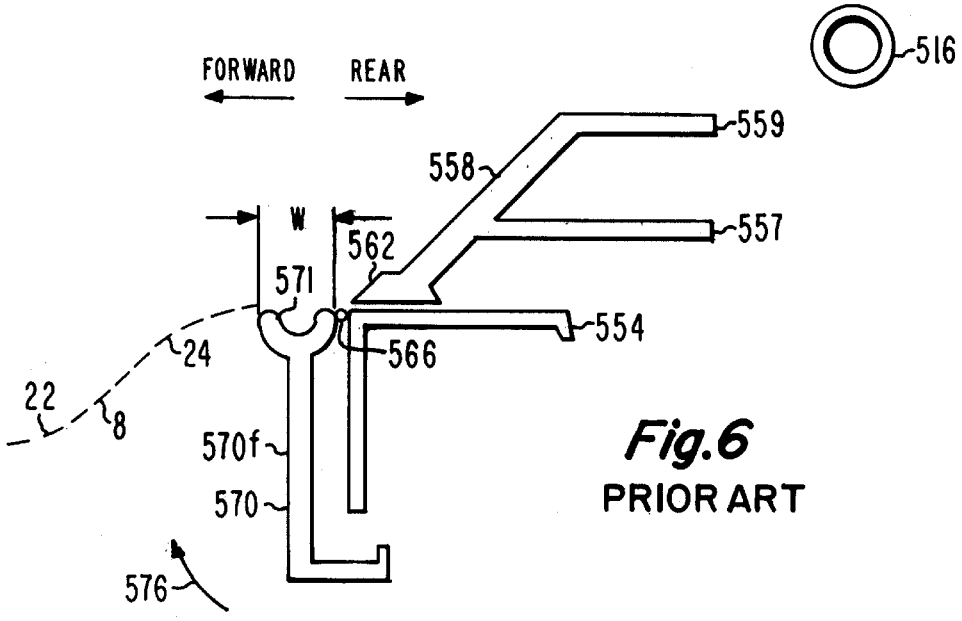
Fig.6 PRIOR ART
FIG. 6 is a simplified cross-sectional view of the portable bending brake of FIG. 5 at a location between clamps, with the clamps not shown for clarity.

It must be understood that, at locations lying between the clamps 500 of FIG. 5, the cross-section of the portable bending brake is considerably different from that illustrated in FIG. 5. More particularly, the brake 500 of FIG. 5 has the cross-sectional appearance illustrated in FIG. 6 when in the clamped position. In FIG. 6, elements corresponding to those of FIG. 5 are designated by like reference numerals. It should be noted that the prior-art brake of FIGS. 5 and 6 cannot make the right-angle bends 26*a,b* and 30*a,b* illustrated in FIG. 4*b*, because the width W of the bending head 571 of apron 570, illustrated in FIG. 6, is almost ¾ inch, which means that the distance between the end of curve 24, for example, and bend 26*a*, would have to be at least ¾ inch; thus the right-angle bends immediately adjacent to the curves cannot be made by the prior-art bending brake, even if the curves themselves could somehow be made.

Figure 7:
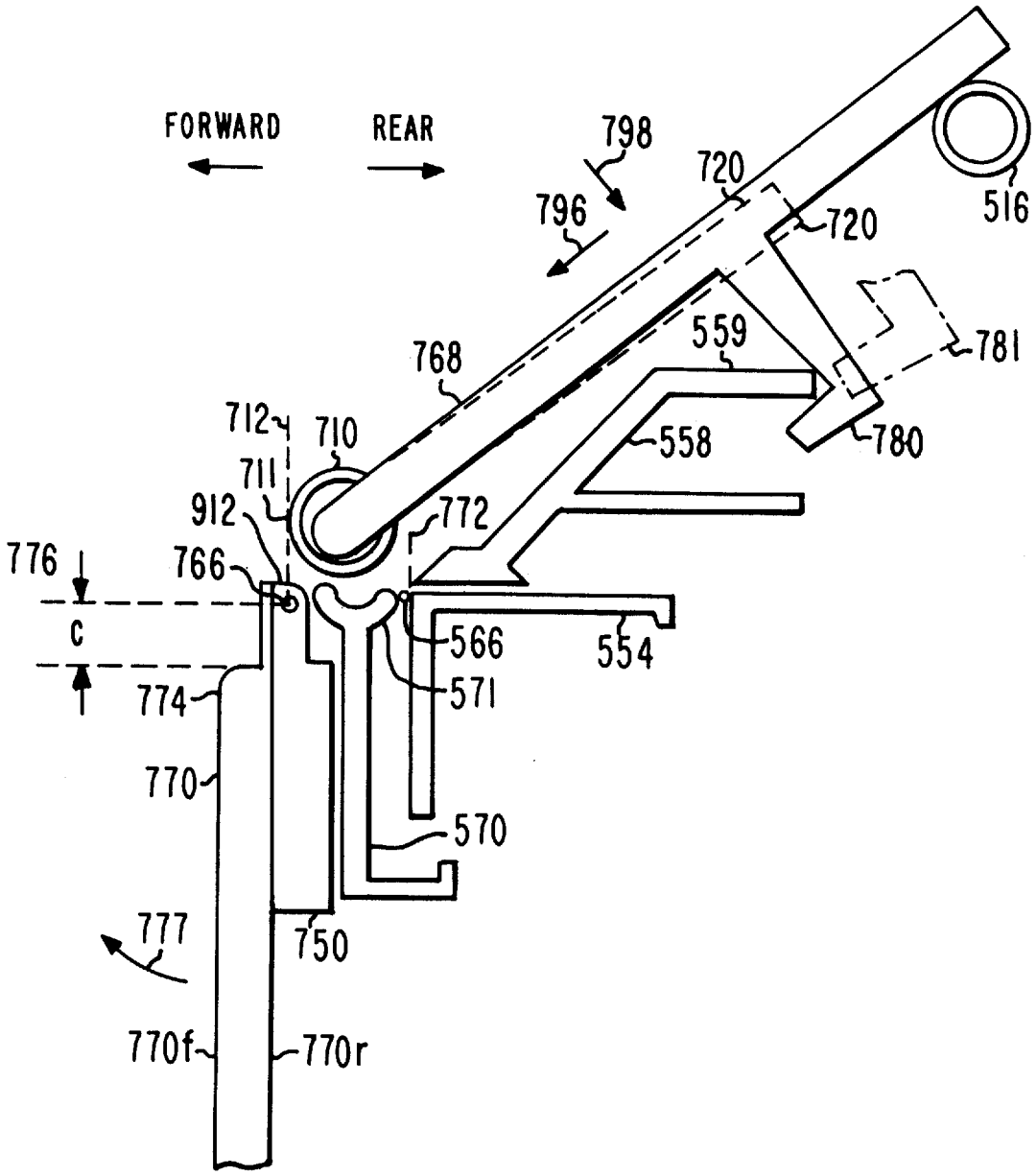
FIG. 7 is a simplified cross-sectional view of the portable bending brake of FIGS. 5 and 6, with the addition of kit accessories including mandrel holder, apron filler piece, and auxiliary apron in accordance with an aspect of the invention, for allowing the fabrication of curves.

According to an aspect of the invention, a kit of accessories for the brake of FIGS. 5 and 6 includes a mandrel holder, designated 768 in FIG. 7, an apron fill piece 750, and an auxiliary apron 770. The mandrel holder 768 holds a curved mandrel, such as a pipe 710, against the outer or forward edge of the bending head 571 of the original apron 570 of the brake, with a vertical plane tangent to its forward surface, such as plane 712 of FIG. 7, well forward of a vertical plane 772 passing through the hinge axis 566 of the apron 570 of the original brake. Mandrel holder 768 is held in position in a manner described below. In addition to mandrel holder 768, the accessory kit includes an apron fill piece 750, which is affixed, in a manner described below, to the original apron 570. A hinge having an axis 766 is mounted near the upper edge of apron fill piece 750. Axis 766 is about in line with vertical plane 712, which is tangent to the front surface of mandrel 710. An auxiliary apron, illustrated as 770, is hinged along axis 766 to apron fill piece 750, and is normally in the pendent position illustrated in FIG. 7. As illustrated, auxiliary apron 770 has a curved forward surface 774, which begins its curvature below a horizontal plane 776 passing through hinge axis 766. The clearance dimension is designated "C." This clearance C is provided to allow a curve to be imparted to a workpiece which already has a pair of closely spaced right-angle bends such as 26*a*, 26*b* of FIG. 4*b*. The dimension C may range from about zero to about ¾ inch.

Figure 8:
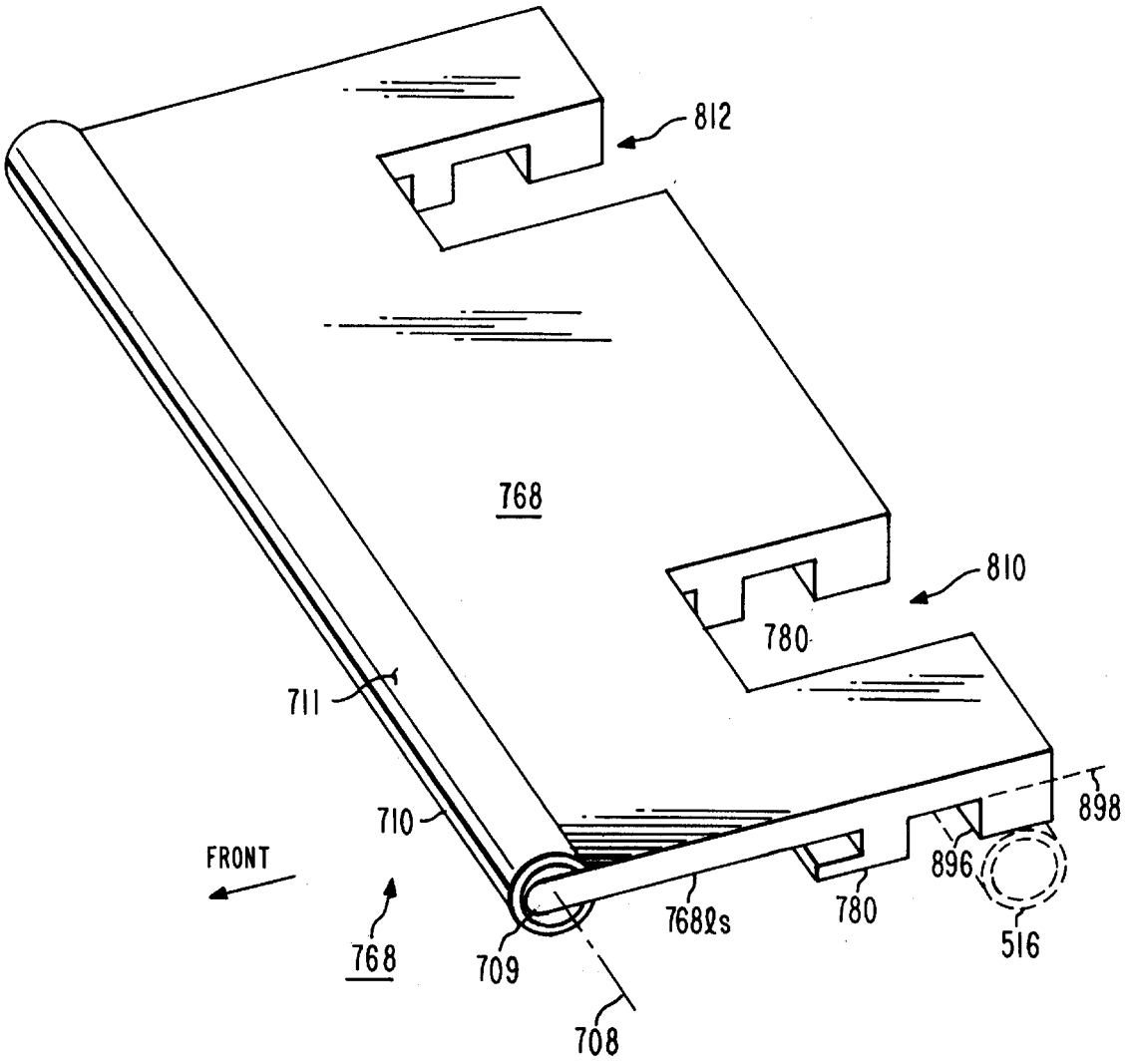
FIG. 8 is a perspective or isometric view of a portion of a mandrel holder corresponding to the mandrel holder of FIG. 7, and the associated mandrel.

The mandrel holder 768 may be held in place in one embodiment, as illustrated in FIG. 7, by providing a hook-like structure 780, which hooks over the upper flange 559 at locations between clamp bodies 510 of FIG. 5. In the embodiment of FIG. 7, the mandrel holder 768 is made from a slightly flexible material, such as plywood, fiberglass-reinforced epoxy, or some equivalent material, which allows the mandrel holder to be slightly flexed, with its ends against the bending head 571 of apron 570 on one side, and against the cam shaft 516 on the other side, with flexure, illustrated by dotted lines 720 in FIG. 7, sufficient to allow the hooking of the hook structure 780 over the upper arm 559 of upper jaw extrusion 558. In this embodiment, the mandrel holder 768 can be quickly assembled without tools or fasteners when the upper jaw extrusion 558 is in its upper position, and is held firmly by the flexure when the upper jaw is closed. The mandrel holder is placed in position by merely laying the mandrel holder 768 over the upper jaw extrusion 558 with the hook portion 780 slightly above the rear edge of the arm 559 of the upper jaw extrusion 558, as illustrated by dot-dash lines 781. The mandrel holder is then pushed in the direction of arrow 798 to spring the hook to the proper position, as suggested by the dash-line position 720, and while sprung, the mandrel holder 768 is pulled in the direction of arrow 796 to hook portion 780 over extrusion arm 559. FIG. 8 is a perspective or isometric view of the mandrel holder 768 with an attached mandrel 710.

In FIG. 8, the direction of elongation of the mandrel holder 768 is indicated by axis 708, which is also the axis of a mandrel or pipe 710 affixed to the distal or forward end 709 of the mandrel holder 768. The structure of the hook 780 is visible in FIG. 8. Cutouts 810 and 812 along the length of the mandrel holder 768 are provided to clear the clamps 500 which occur along the length of the brake. While only two cutouts are illustrated, there should be as many cutouts as there are clamps located along the length of the brake. It may not be necessary to provide a cutout for the two clamps located near the ends of the brake. As illustrated in FIG. 8, the cam shaft 516 lies a bit below a projection 898 of the lower surface 768ls of the mandrel holder 768. A shoe or fill piece 896 fills the space between lower surface 768ls and the upper surface of the cam shaft 516, and can be adjusted in thickness to provide the proper level of spring or flexure for holding the mandrel holder 768 in position without slippage.

Figure 9:
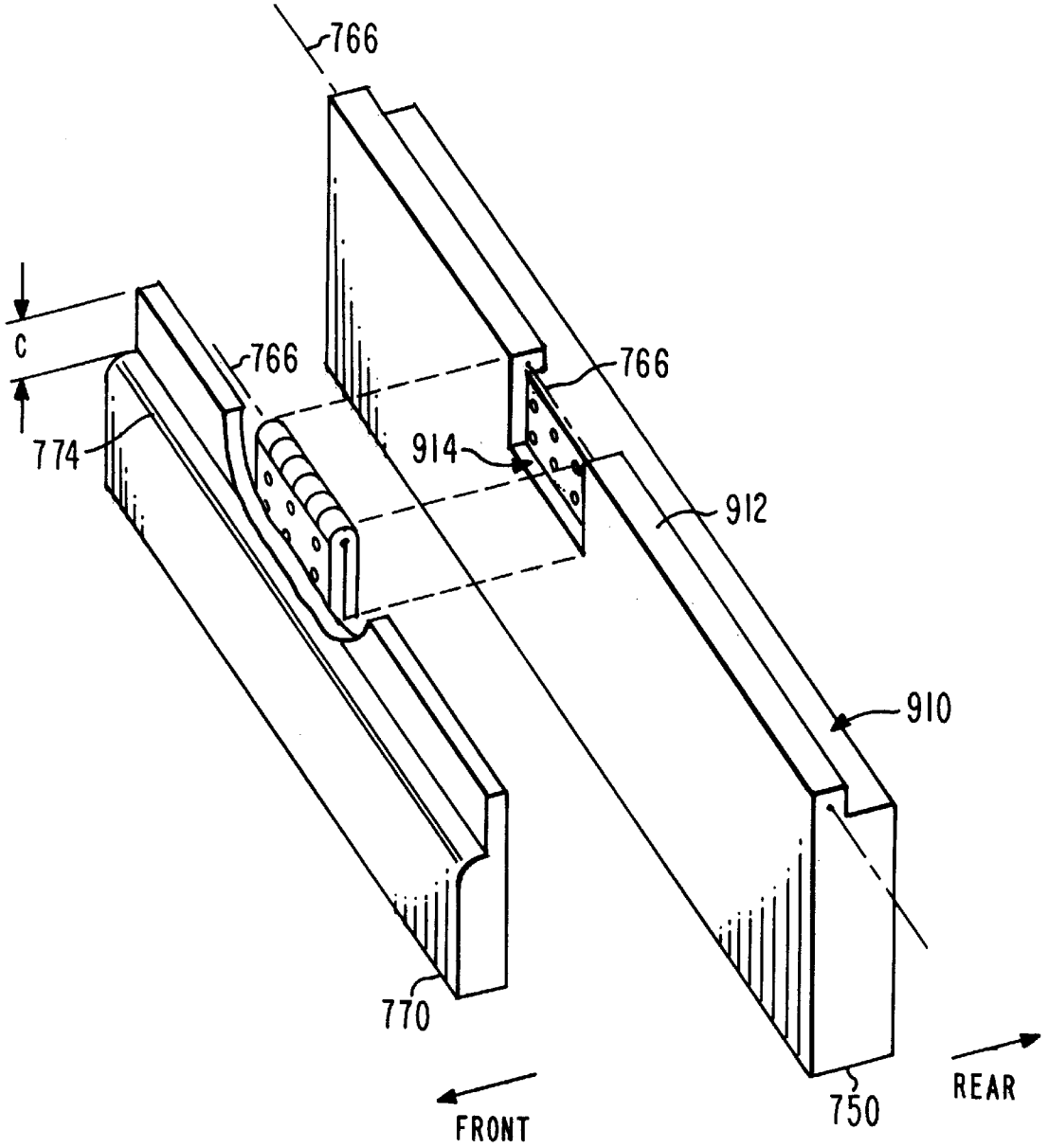
FIG. 9 is a simplified perspective or isometric view of portions of the apron fill piece and the the auxiliary apron of the accessory kit according to the invention, exploded away from each other to reveal details.

FIG. 9 is a simplified perspective or isometric view of portions of the apron fill piece 750 and the the auxiliary apron 770 of the accessory kit according to the invention. In FIG. 9, the apron fill piece has a notch 910 cut out of its upper surface, or alternatively has a raised portion 912. A cut-away space 914 is provided for placement of a hinge, illustrated as a common hinge 920, with its hinge axis coincident with hinge axis 766 of FIG. 7. The auxiliary apron 770 is also illustrated, showing the location of the hinge relative to the curved surface 774. Those skilled in the art will understand that the hinge used in an actual accessory kit may be a piano-style hinge, to provide complete support over the length of the bending brake, or that alternatively, several hinges such as hinge 920 may be spaced along the length.

Figure 10A:
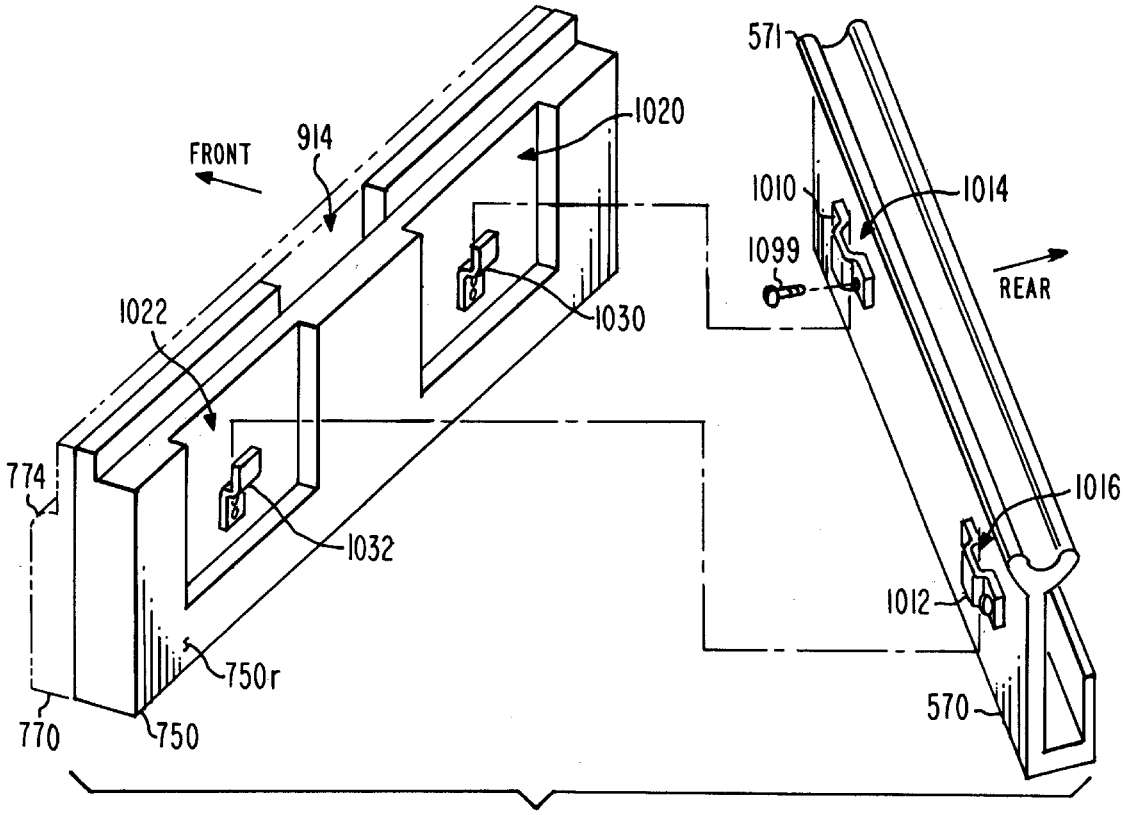
FIG. 10*a* is a simplified perspective or isometric view of a portion of the apron of the portable bending brake of FIG. 5, together with the abutting part of a portion of the apron fill piece of the accessory kit, showing how the two are provided with quick-connects.
Figure 10B:
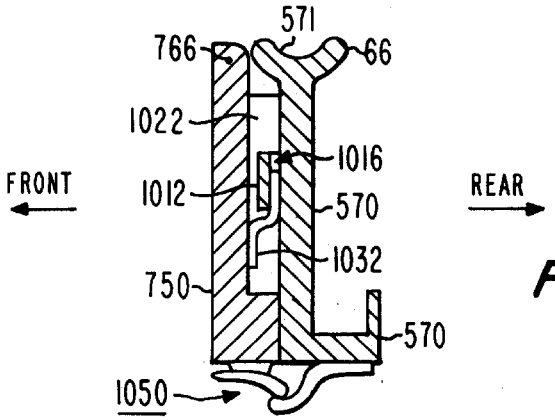
FIG. 10*b* is an end view of the two in their joined condition.

FIG. 10*a* is a simplified perspective or isometric view of a portion of the apron 570 of the portable bending brake of FIG. 5, together with the abutting part of a portion of the apron fill piece 750 of the accessory kit, showing how the two are provided with quick-connects, and FIG. 10*b* is an end view of the two in their joined condition. In FIG. 10*a*, the front surface of apron 570 is fitted with two bent straps 1010, 1012, each defining, when affixed to the front face of the apron, a vertically oriented, roughly rectangular slot 1014, 1016. The straps may be held onto the front of apron 570 by any appropriate means, such as screws, one of which is illustrated as 1099. At corresponding locations on the facing (rear) surface of the apron fill piece 750 are apertures or cutouts 1020, 1022, which provide clearance to accept the bodies of the straps 1010, 1012, so that the front face 570 of the apron can fit flush against the rear face 750*r* of the apron fill piece 750. At the bottom surface of each aperture or cutout 1020, 1022, a rectangular, upstanding tab 1030, 1032 is affixed (by screws, adhesive, or any means) in a position such that, when the tabs 1030, 1032 engage slots 1014, 1016, respectively, the front surface 570*f* is held contiguous with rear face 750*r* of apron fill piece 750. The apron fill piece is easily installed by simply placing it against the apron 570 at a location slightly lower than its proper position, and raising it slightly to engage the tabs in the slots. It will be appreciated that the number of such tab-slot combinations will depend upon the length of the accessory kit pieces, and the desired rigidity. In order to keep the apron fill piece 750 from disengaging itself from the apron 570 due to the effect of gravity acting on the tabs and slots, one or more fasteners 1050 may be placed along the bottom edges of the apron 570 and apron fill piece 750, as illustrated in FIG. 10*b*. The fastener(s) may be of any type, but one which provides a camming action to force the apron fill piece 750 upward, and closer to the apron, is preferred. As illustrated in FIG. 10*b*, the fastener 1050 is an ordinary cam-style fastener as commonly used on double-hung windows.

In operation of the accessory kit illustrated in FIGS. 7, 8, 9, 10*a*, and 10*b*, the upper jaw control handle 522 of the portable bending brake is used to raise the upper jaw 558 and attached mandrel 710 to provide clearance for insertion of a sheet metal workpiece into the gap between the lower curved surface 711 of the mandrel 710 and the upper surface 912 of the apron fill piece 750. With the workpiece in place, the jaw is then closed, which pinches the workpiece between the lower curved surface of mandrel 710 and either the upper surface 912 of the apron fill piece 750 or the bending head 571 of the apron 570, which is immediately adjacent thereto. The mandrel holder 768 can be positioned so that the pinching takes place at either of the locations, as desired. With the workpiece in place, auxiliary apron 770 is raised or rotated about axis 766 in the direction of arrow 777, with the help of a handle (not illustrated) if desired. The first few degrees of rotation will not bring the curved surface 774 into contact with the underside of a flat workpiece, but may bring it into contact with a workpiece which already has a downward curve. Continuation of the raising or rotation of the auxiliary apron 770 then forces the workpiece around the mandrel 710 in a manner which will be apparent to those skilled in the art. After the bend is made, the upper jaw is raised to raise the mandrel away from the pinch region, and the workpiece can then be repositioned for another bend, or put aside for later steps in the installation.

Figure 11A:
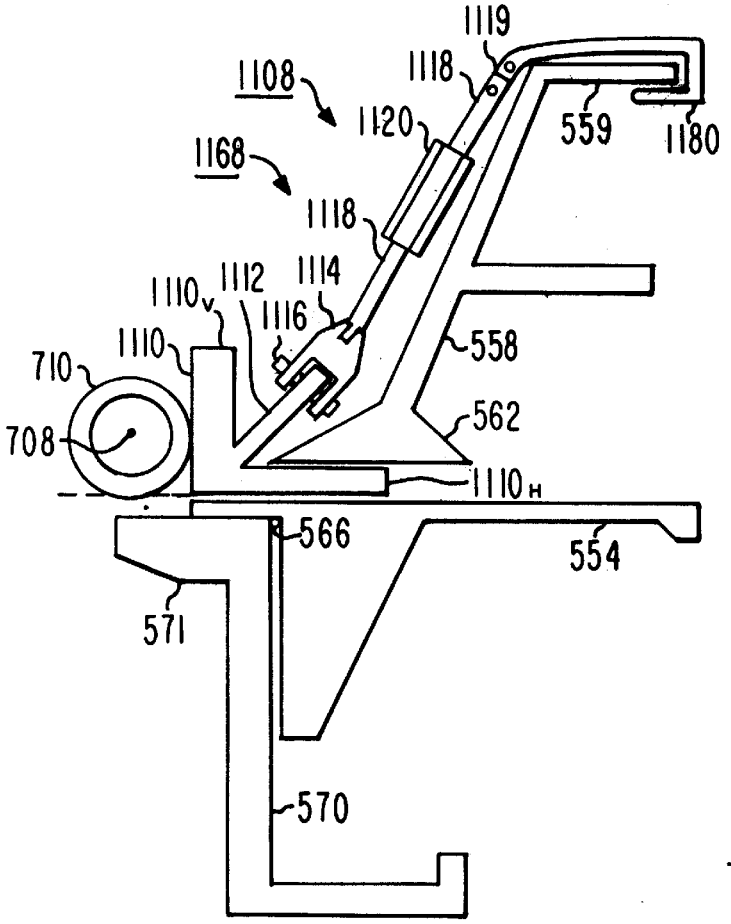
FIG. 11*a* is a simplified cross-sectional view of a portable bending brake similar to that of FIGS. 5 and 6, fitted with a different embodiment of a mandrel in accordance with an aspect of the invention.
Figure 11B:
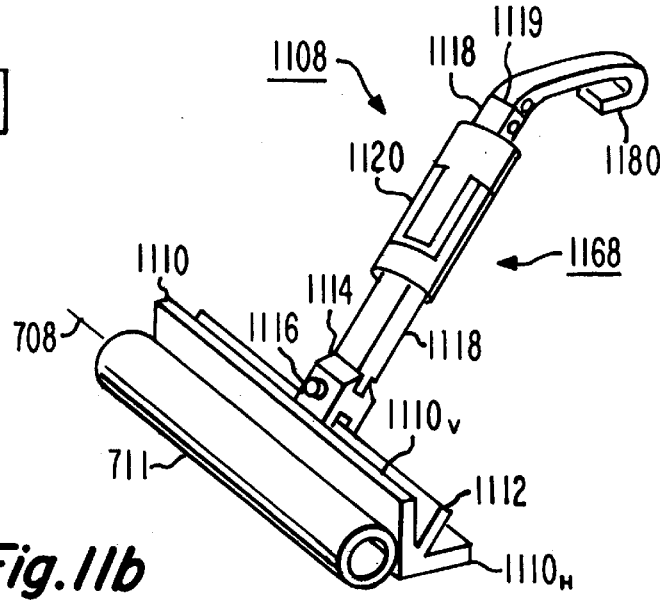
FIG. 11*b* is a simplified perspective or isometric view of the mandrel holder of the arrangement of FIG. 11*a;*

FIG. 11*a* is a cross-sectional view of a portable bending brake similar to that of FIGS. 5 and 6, fitted with a different embodiment of a mandrel in accordance with an aspect of the invention, and FIG. 11*b* is a perspective or isometric view of a portion of the mandrel holder of FIGURE 11*a*. In FIGS. 11*a* and 11*b*, the mandrel holder is designated generally as 1168, and the mandrel itself is a pipe 710 having an axis of elongation 708 which is parallel to apron hinge axis 566. The mandrel holder 1168 may be viewed as including an elongated metal support 1110, in the general form of a letter "L" with vertical and horizontal elements $\mathbf{1110}_V$ and $\mathbf{1110}_H$, respectively, and with an additional arm or element 1112, which is at about a 45° angle from the sides $\mathbf{1110}_V$ and $\mathbf{1110}_H$ of support 1110. As illustrated in FIG. 11*a*, the lower element $\mathbf{1110}_H$ of L-shaped piece 1110, when in use, is clamped between lowermost portion 562 of clamping bar 558 and the adjacent portion of the upper surface of lower beam 554. This holds the mandrel holder 1168 in position when the clamp 558 is closed against lower beam 554, but when the clamp 558 is open to allow a workpiece to be inserted, the mandrel holder 1168 becomes loose, which makes proper placement of the workpiece difficult. In order to raise and lower the mandrel holder 1168 together with the clamp 558, a plurality of tensionable strap arrangements 1108 are hooked from the additional element 1112 of mandrel holder 1168 and the rearward-projecting portion 559 of clamp 558.

One of the tensionable strap arrangements which holds the mandrel holder 1168 to the upper clamp element 558 of the portable bending brake is illustrated in FIG. 11*b*. A somewhat flexible strap 1118 connects at one end to a furcated connector 1114 which is fastened by a pin or screw 1116 to the additonal element 1112 of mandrel holder 1168. The other end of strap 1118 connects at a junction 1119 to a rigid hook-like member 1180, which, in use, hooks over rearward-projecting element 559 of upper clamp 558. A tensioning device, illustrated as 1120, is affixed to the strap at some location along the strap, which may be the illustrated location, to tension the strap. The tensioning device may be a common over-center device, or it could be a screw clamp. To assemble the mandrel holder in this embodiment, the hooks 1180 are place over the rearward projections 559, the lower element $\mathbf{1110}_H$ of the mandrel holder 1110 is placed under the clamp 558, and the tensioning devices are operated, to pull the mandrel holder 1168 into intimate contact with the upper clamp 558.

Figure 12:
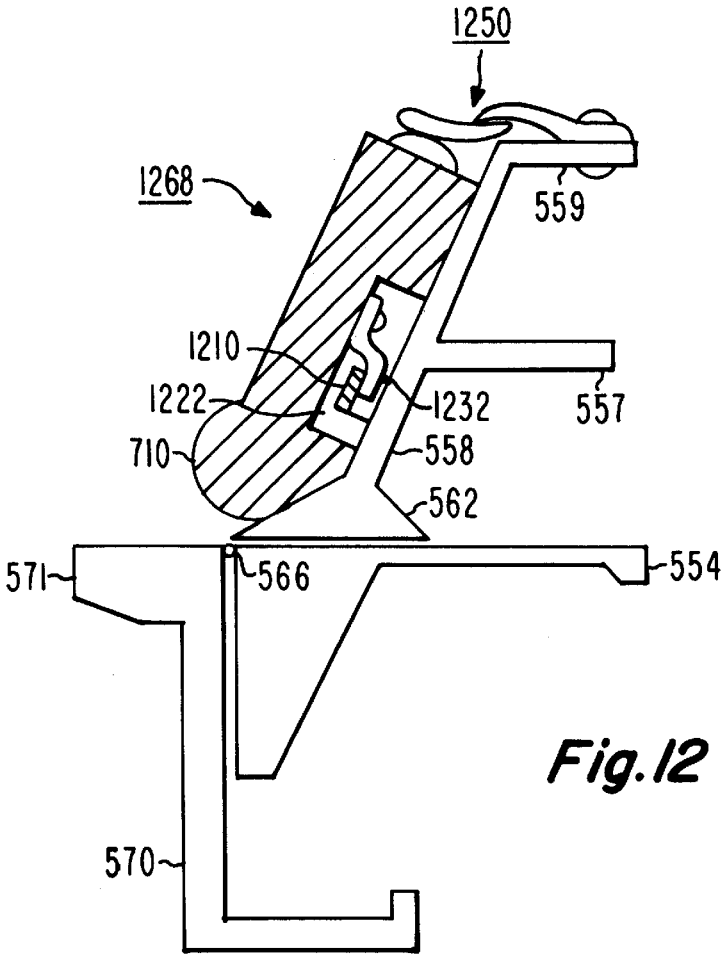
FIG. 12 is a cross-section of a portable bending brake according to an aspect of the invention, in which the mandrel holder is affixed to the upper clamp by means of straps.

FIG. 12 is a cross-section of a portable bending brake according to an aspect of the invention, in which the mandrel holder 1268 is affixed to the upper clamp 558 by means of straps 1210 affixed to the upper clamp, and defining slots 1214, much as described in conjunction with FIGS. 11*a* and 11*b*, together with bent tabs 1232 affixed to cutouts 1222 in the mandrel holder 1268. A wedge-type holder 1250 places force on the mandrel holder 1268 to maintain the tabs in the slots.

Figure 13:
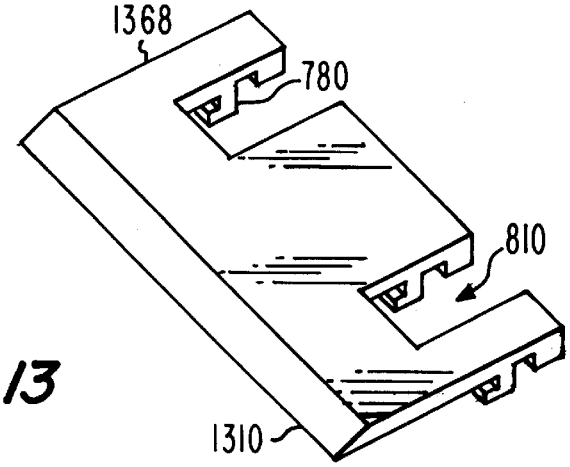
FIG. 13 is a perspective or isometric view of another type of mandrel holder which may be used in the accessory kit.

It has been found during fabrication that it is often necessary to make bends in a sequence in which curved bends alternate with straight bends. Rather than demount both the mandrel holder 768, 1168, or 1268 and the apron fill piece 750 (together with its auxiliary apron 770) 770 of the adaptation kit from the portable bending brake, it may be easier to simply remove the mandrel holder having the curved mandrel, and substitute an auxiliary straight mandrel holder. FIG. 13 illustrates an auxiliary straight mandrel holder 1368 similar to mandrel holder 768 of FIG. 8, but in which the mandrel is an ordinary straight bending edge 1310. The preferred kit of accessory parts includes three mandrel holders (one straight-edged 1310, one half-inch diameter pipe mandrel such as 768, 1168, or 1268, and one one-inch pipe mandrel of the same type), one apron fill piece 750, and one auxiliary apron 770.

Thus, an accessory kit according to the invention allows the fabrication of elongated sheet-metal workpieces (8) having curved surfaces (22, 24, 28) on a sheet-metal bending brake. The sheet-metal bending brake (500) for which the accessory kit is provided includes (a) an elongated bed (54; 554) defining a generally horizontal support surface for a sheet-metal workpiece (80), (b) an elongated clamp (58; 558) which is movable relative to the bed (54; 554) for clamping the sheet-metal workpiece (80) against the bed (54; 554), the clamp (54; 554) defining a front edge (62; 562), and (c) an elongated apron (70; 570) hingedly connected along a first hinge axis (66; 566) near the front edge (62; 562) of the clamp (54; 554) for bending that portion of the sheet-metal workpiece (80) extending forward of the front edge (62; 562) of the clamp 54; 554) relative to that portion lying to the rear of the front edge (62; 562) of the clamp (54; 554).

The accessory kit comprises an elongated mandrel holding piece (768; 1168; 1268) which may be affixed to the clamp (54; 554) of the bending brake (500) for use therewith. At least one of the mandrel holding pieces (768; 1168; 1268) includes a mandrel (710) in the form of an elongated curved surface (711). The elongated curved surface (711) has a cross-section along a principal portion of its length which is the same as the cross-section at other locations along the principal portion of its length, to thereby define an axis of elongation (708) of the curved surface. The axis of elongation (708) extends parallel to the direction of elongation of the mandrel holding piece (768; 1168; 1268), near a front edge (709) of the mandrel holding piece (768; 1168; 1268). The elongated mandrel holding piece (768; 1168; 1268), when affixed to the clamp (58; 558), has the axis of elongation (708) of the elongated curved surface (711) lying parallel to the front edge (62; 562) of the clamp (58; 558), and the foremost or forward portion (711) of the curved surface lying forward of a vertical plane (772) passing through the first hinge axis (66, 566). Thus, the mandrel (710) may be, in one embodiment, a portion of a circularly cylindrical tube, pipe or rod, with its axis (708) parallel to the front edge (62; 562) of the clamp (54; 554), with a vertical plane (712) tangent to its curved forward surface (711) lying forward of a vertical plane (772) passing through and including the hinge axis (66; 566) of the bending brake (500).

The accessory kit includes an elongated apron fill piece (750) which may be affixed to the apron (70; 570) of the bending brake (500). The apron fill piece (750) includes an elongated hinge-type support (766; 920) which, when the apron fill piece (750) is affixed to the apron (570) of the bending brake (500) and the mandrel holding piece (768; 1168; 1268) is affixed to the clamp 558), has a second hinge axis (766) lying near the vertical plane (712) tangent to the curved front surface (711) of the mandrel (710). The accessory kit further includes an elongated auxiliary apron (770) defining a front surface (770*f*) and a back surface (770*r*). The auxiliary apron (770) is hinged to the apron fill piece (750) along the second hinge axis (766), with the front surface (770*f*) of the auxiliary apron (770) facing away from the apron fill piece (750), so that the auxiliary apron (770) in its non-bending or pendulous normal position lies generally below the support plane (776) of the bed (54; 554), and may be raised or rotated about the second hinge axis (766) for bending the sheet-metal workpiece (80) without raising the apron (570) of the bending brake (500). The auxiliary apron (770) defines a second curved surface (774) on, or adjacent to, its front surface (770*f*). The second curved surface (774) has an axis of elongation (766) lying parallel to the axis of elongation (708) of the curved surface (711) of the mandrel (710). The second curved surface (774) is located below the hinge axis (776) when the auxiliary apron (770) is in its normal or pendulous position, so as to provide clearance for sheet-metal workpieces which may already have a curve.

The preferred accessory kit includes three mandrel holding pieces, two of which bear mandrels of different sizes, such as 1" diameter and ½ diameter, and one of which has a straight edge, and the kit also includes one apron fill piece and one auxiliary apron with curved front surface set below the clamp surface.

A mandrel holder (FIG. 8) according to an aspect of the invention includes an elongated support member (768) defining a straight front edge. A curved, elongated mandrel (710) is mounted contiguous with, and parallel to, the front edge of the support member (768). The support member (768) further including means, such as the hook (780) or the slots and tabs (1010, 1030), for mounting the support member (768) onto the clamp (768) of the bending brake (500) with an axis of elongation (708 of the mandrel parallel with the front edge (562) of the clamp (558) of the bending brake (500), and with a vertical plane (712) tangent to the front surface (711) of the mandrel (710) lying forward of a vertical plane (772) passing through the forward edge of the apron (570) of the brake (500) in the pendent position (FIG. 7) of the apron (570). Such a mandrel, when used with relatively thin sheet metal, such as the aluminum used for sheathing of exposed wood, can be used even without the auxiliary apron, although there is less control over the quality of the curved bend. The bend is made simply by using the hands, possibly with a soft, elongated tool, to put pressure on the workpiece to bend it around the mandrel. In such a case, the accessory kit consists only of one mandrel holder, or of a small plurality of mandrel holders with mandrels of different diameters.

Other embodiments of the invention will be apparent to those skilled in the art. For example, while the invention has been described using aluminum sheet as an example, the invention may be used with other metal workpieces, such as, for example, tin, copper, of galvanized steel, all of which have been successfully used in the past for exterior surfaces. While particular shapes of bent aluminum sheaths have been discussed, the invention is not limited to such shapes, but can be used to fabricate sheaths having a very large, almost infinite, combination of cross-sectional curves, bends and straight portions. While the straps 1010, 1012 &tc. of FIG. 10*a* have been described as being held on by screws, other securing arrangements may be used to affix apron fill piece 750 to the front of the apron 570; even adhesives might be used if ready demounting were not important. While the clamp of the bending brake has been described as being movable, the only actual requirement is for relative motion between the clamp and the bed.

What is claimed is:

1. An accessory kit for allowing the fabrication of elongated sheet-metal workpieces having curved surfaces on a sheet-metal bending brake, said sheet-metal bending brake including (a) an elongated bed defining a generally horizontal support surface for a sheet-metal workpiece, (b) an elongated clamp which is movable relative to said bed for clamping said sheet-metal workpiece against said bed, said clamp defining a front edge, and (c) an elongated apron hingedly connected along a first hinge axis near said front edge of said clamp for bending that portion of said sheet-metal workpiece extending forward of said front edge of said clamp relative to that portion lying to the rear of said front edge of said clamp, said accessory kit comprising:

an elongated mandrel holding piece which may be affixed to said clamp of said bending brake, said mandrel holding piece including a mandrel in the form of an elongated curved surface, said elongated curved surface having a cross-section along a principal portion of its length which is the same as the cross-section at other locations along said principal portion of its length, to thereby define an axis of elongation of said curved surface, said axis of elongation extending parallel to the direction of elongation of said mandrel holding piece near a front edge of said mandrel holding piece, said elongated mandrel holding piece, when affixed to said clamp, having said axis of elongation of said elongated curved surface lying parallel to said front edge of said clamp, and said curved surface lying forward of a vertical plane passing through said first hinge axis;

an elongated apron fill piece which may be affixed to said apron of said bending brake, said apron fill piece including an elongated hinge support which, when said apron fill piece is affixed to said apron of said bending brake and said mandrel holding piece is affixed to said clamp, has a second hinge axis lying near the foremost vertical plane tangent to said curved surface of said mandrel;

an elongated auxiliary apron defining a front surface and a back surface, said auxiliary apron being hinged to said apron fill piece along said second hinge axis, with said front surface of said auxiliary apron facing away from said apron fill piece, whereby said auxiliary apron in its non-bending normal position lies generally below said support plane of said bed, and may be raised about said second hinge axis for bending said sheet-metal workpiece without raising said apron of said bending brake, said auxiliary apron defining a second curved surface on said front surface, said second curved surface having an axis of elongation lying parallel to said axis of elongation of said curved surface of said mandrel, said second curved surface being located below said hinge axis when said auxiliary apron is in its normal position, to thereby provide clearance for sheet-metal workpieces which may already have a downward curve.

2. An accessory kit according to claim 1, wherein:

said clamp of said bending brake has a rearward-projecting piece and a clamp positioning shaft, and wherein said mandrel holding piece comprises a bearing portion which, when said mandrel holding piece is installed on said bending brake, bears against said shaft, and said mandrel holding piece further includes a hook-like structure, which, when said bearing portion bears on said shaft and said mandrel bears on one of said apron fill piece and said apron, may be hooked over said rearward-projecting piece of said clamp of said bending brake.

* * * * *